US009742084B2

(12) United States Patent
Asanuma

(10) Patent No.: US 9,742,084 B2
(45) **Date of Patent: *Aug. 22, 2017**

(54) CONNECTOR AND MANUFACTURING METHOD THEREFOR

(71) Applicant: Molex, LLC, Lisle, IL (US)

(72) Inventor: Junichi Asanuma, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/376,163

(22) Filed: Dec. 12, 2016

(65) Prior Publication Data

US 2017/0093066 A1 Mar. 30, 2017

Related U.S. Application Data

(63) Continuation of application No. 15/064,131, filed on Mar. 8, 2016, now Pat. No. 9,553,384.

(30) Foreign Application Priority Data

Apr. 1, 2015 (JP) ..... 2015-074939

(51) Int. Cl.
*H01R 12/88* (2011.01)
*H01R 12/77* (2011.01)

(52) U.S. Cl.
CPC ..... *H01R 12/774* (2013.01)

(58) Field of Classification Search
CPC ..... H01R 12/88; H01R 12/79; H01R 12/81; H01R 12/83; H01R 12/85; H01R 12/778
USPC ..... 439/260, 261, 326–329
See application file for complete search history.

(56) References Cited

U.S. PATENT DOCUMENTS

| | | | |
|---|---|---|---|
| 6,099,346 | A | 8/2000 | Hashiguchi |
| 6,755,682 | B2 | 6/2004 | Kunishi |
| 8,636,531 | B2 | 1/2014 | Sasaki et al. |
| 9,070,993 | B2 | 6/2015 | Honda |
| 9,281,593 | B2 | 3/2016 | Honda |
| 2007/0105423 | A1 | 5/2007 | Gillespie |
| 2008/0096431 | A1 | 4/2008 | Chen |
| 2009/0130881 | A1 | 5/2009 | Suzuki |

FOREIGN PATENT DOCUMENTS

| | | | |
|---|---|---|---|
| JP | 2009-064743 | A | 3/2009 |
| JP | 2010-257676 | A | 11/2010 |
| JP | 2012-221841 | A | 11/2012 |
| JP | 2012-234646 | A | 11/2012 |
| JP | 2012-238434 | A | 12/2012 |

*Primary Examiner* — Harshad Patel
(74) *Attorney, Agent, or Firm* — James A. O'Malley

(57) ABSTRACT

A connector is provided which includes engaging portions for engaging hooks formed on the upper arm portion of each terminal, an actuator having two contact pressure portions formed on each of two end surfaces positioned on opposite sides from each other in the left and right direction, and a housing having two holding portions opposing each other on the left and right sides and interposing the actuator. The holding portions press against the contact pressure portions of the actuator in a second position and do not press against the contact pressure portions of the actuator in a first position, where the position of the actuator when the engaging portions are engaging the hooks is the first position and the position of the actuator when the engaging portions are not engaging the hooks is the second position.

16 Claims, 8 Drawing Sheets

CONNECTOR AND MANUFACTURING METHOD THEREFOR

RELATED APPLICATIONS

This application is a continuation of U.S. patent application Ser. No. 15/064,131, filed Mar. 8, 2016, which, in turn, claims priority to Japanese Application No. 2015-074939, filed Apr. 1, 2015, each of which are incorporated herein by reference in their entireties.

TECHNICAL FIELD

The present disclosure relates to a connector and to a manufacturing method therefor.

BACKGROUND ART

Patent Documents 1 and 2 disclose a connector and a manufacturing method for a connector used to connect flat wiring (a flexible substrate in Patent Document 1) from the front. A section (mounting recessed portion 110 in Patent Document 1) is formed in the housing for the connector (body 100 in Patent Document 1) for housing an actuator (actuator 300 in Patent Document 1).

In the manufacturing process for the connector, there is a step in which the actuator is inserted into the housing. Contact pressure portions formed on the end surfaces on opposite sides of the actuator in the lateral direction (such as the protruding portions 350 in Patent Document 1) are pressed against holding portions on opposite sides of the housing in the lateral direction (such as the left and right inner walls of the mounting recessed portion 110 in Patent Document 1) to facilitate provisional retention (referred to below as temporary retention) of the actuator.

In the manufacturing process for the connector, there is also a step in which a support member (referred to as a nail or retainer) is inserted into the housing after the actuator has been inserted into the housing. The inserted support member is pushed against the actuator from below, the actuator is pushed upwards in the housing, and the actuator moves into the proper position for the product. When the actuator has moved into the proper position, it engages terminal hooks inserted beforehand into the housing to reliably hold the actuator and prevent the actuator from becoming detached from the connector. Because the actuator engages terminal hooks, the hooks must be able to rotate in the vertical direction around the engaging portion where the hooks are engaged (referred to sometimes as a cam).

Patent Document 1: Laid-Open Patent Publication No. 2010-257676

Patent Document 2: Laid-Open Patent Publication No. 2009-064743

SUMMARY

The connector is mounted on a substrate during a reflow step after the actuator has moved into the proper position. When the material constituting the housing is different from the material constituting the actuator and the connector is mounted on a substrate, the connector itself becomes warped into an arc-like shape with the upper portions of the left and right side surfaces of the housing becoming inclined in a direction moving the side surfaces away from each other, and the product cannot be kept in a sufficiently flat state. More specifically, when the thermal expansion co-efficient of the material constituting the actuator is higher than the thermal expansion coefficient of the material constituting the housing, the heat of the reflow process causes the actuator to expand. As a result, the contact pressure portions of the actuator press too hard against the holding portions of the housing, and the connector becomes warped.

The present disclosure provides a connector and a manufacturing method for a connector in which flatness is not impaired even when the actuator expands.

The present disclosure provides a connector comprising: a housing able to receive flat wiring inserted from the front; terminals held inside the housing, each terminal having an arm portion arranged above the flat wiring; and an actuator for pressing down on the flat wiring, the actuator having engaging portions for engaging a hook formed in each arm portion, two contact pressure portions formed on the two end surfaces on opposite sides from each other in the left and right direction; the housing having two holding portions on the opposing left and right sides interposing the actuator, the holding portions pressing against the contact pressure portions of the actuator in a second position and the holding portions not pressing against the contact pressure portions of the actuator in a first position, the position of the actuator when the engaging portions are engaging the hooks being the first position and the position of the actuator when the engaging portions are not engaging the hooks being the second position. In this way, the connector can remain flat even when the actuator expands.

In one aspect of the present disclosure, the engaging portions of the actuator are positioned below the hooks and are caught by the hooks, and the second position is defined as below the first position.

In one aspect of the present disclosure, each holding portion has a first surface facing an end surface of the actuator and a second surface indented relative to the first surface, each contact pressure portion of the actuator presses against a first surface of a holding portion in the second position, and each contact pressure portion of the actuator does not press against a first surface and moves away from a second surface of a holding portion in the first position.

In one aspect of the present disclosure, each second surface is formed above a first surface.

In one aspect of the present disclosure, each holding portion also has an inclined surface positioned in front of the first surface and inclined away from the contact pressure portion of the actuator.

In one aspect of the present disclosure, each contact pressure portion of the actuator protrudes from the end surface.

In one aspect of the present disclosure, the actuator also has a protruding portion protruding from each end surface and having a protrusion length smaller than that of the pressure contact portion, and each protruding portion on the actuator in the first position does not press against the first surface of a holding portion but rather is apart from the first surface.

In one aspect of the present disclosure, the housing also has a bulging portion above each holding portion, and the contact pressure portions of the actuator press against a bulging portion when the actuator is moving upwards.

The present disclosure also provides a method of manufacturing a connector comprising the steps of: inserting terminals each having an arm portion arranged above flat wiring into a housing able to receive flat wiring inserted from the front and having two holding portions opposing each other on the left and right sides; inserting an actuator for pressing down on the flat wiring and having engaging portions for engaging hooks formed in the first (sic) arm portions, and two contact pressure portions formed on each of two end surfaces on opposite sides of each other in the left and right direction, the actuator being inserted into a second position in the housing; and pushing the actuator into a first position in the housing; the second position being the position of the actuator when the engaging portions are not engaging the hooks, and the position of the actuator when the holding portions are pressing against the contact pressure portions; and the first position being the position of the actuator when the engaging portions are engaging the hooks, and the position of the actuator when the holding portions are not pressing against the contact pressure portions.

DETAILED DESCRIPTION OF THE PREFERRED EMBODIMENTS

The following is an explanation of a mode of embodying the disclosure (referred to below as an embodiment) with reference to FIG. 1 through FIG. 10. In each drawing, the directions denoted by X1 and X2 are, respectively, the left and right directions, the directions denoted by Y1 and Y2 are, respectively, the front and rear directions, and the directions denoted by Z1 and Z2 are, respectively, the up and down directions.

Figure 1:
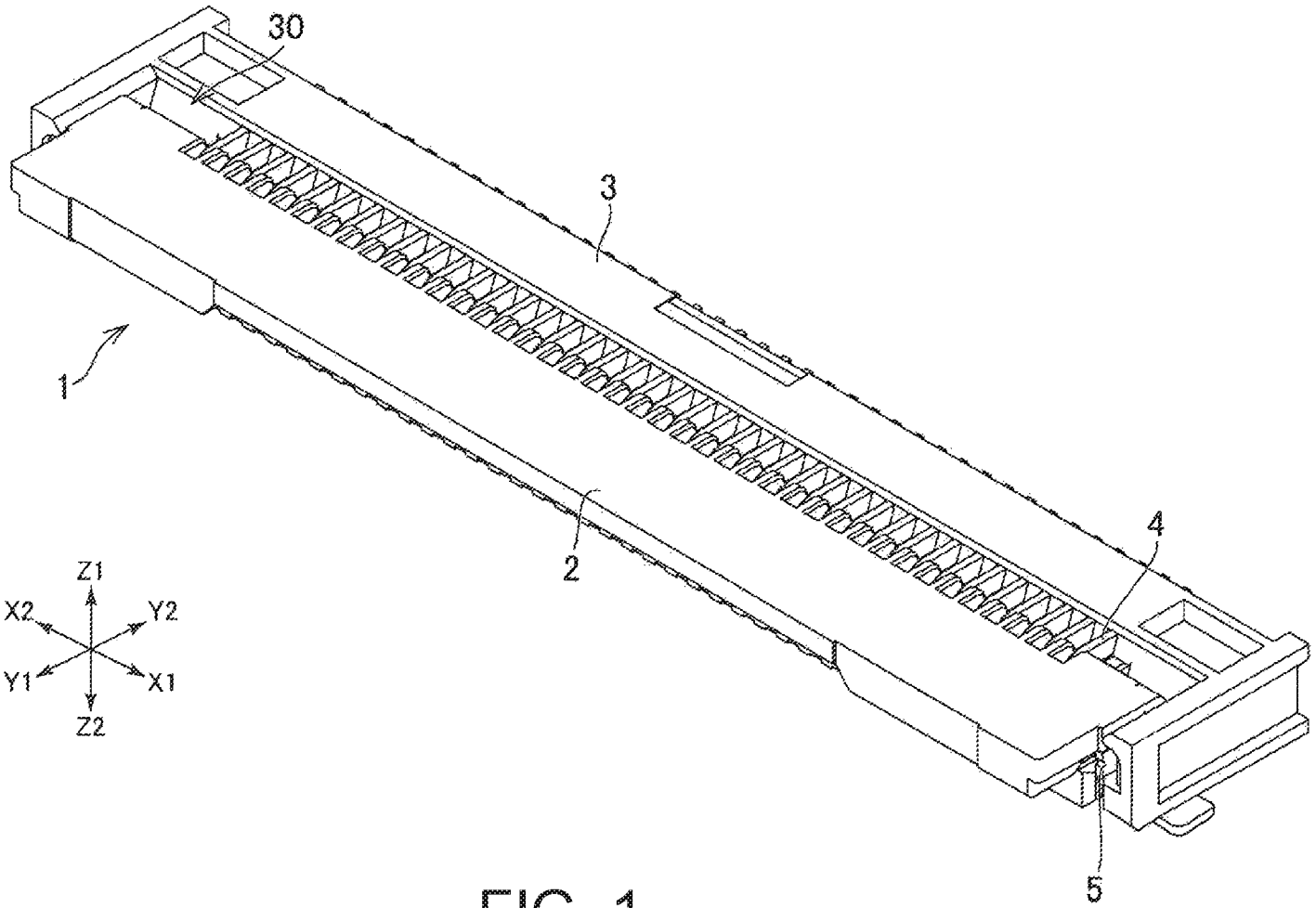
FIG. 1 is a perspective view of a connector in an embodiment of the present disclosure.

FIG. 1 is a perspective view of the connector 1. As shown in the figure, the connector 1 includes an actuator 2 and a housing 3. The actuator 2, which can be made, for example, of a nylon-based resin, is held inside a housing 3. The housing 3 can be made, for example, of a liquid crystal polymer (LCP), and includes an accommodating portion 30 on the front side, which is a space for housing the actuator 2. The housing 3 is able to receive flat wiring (not shown) from the front.

Figure 2:
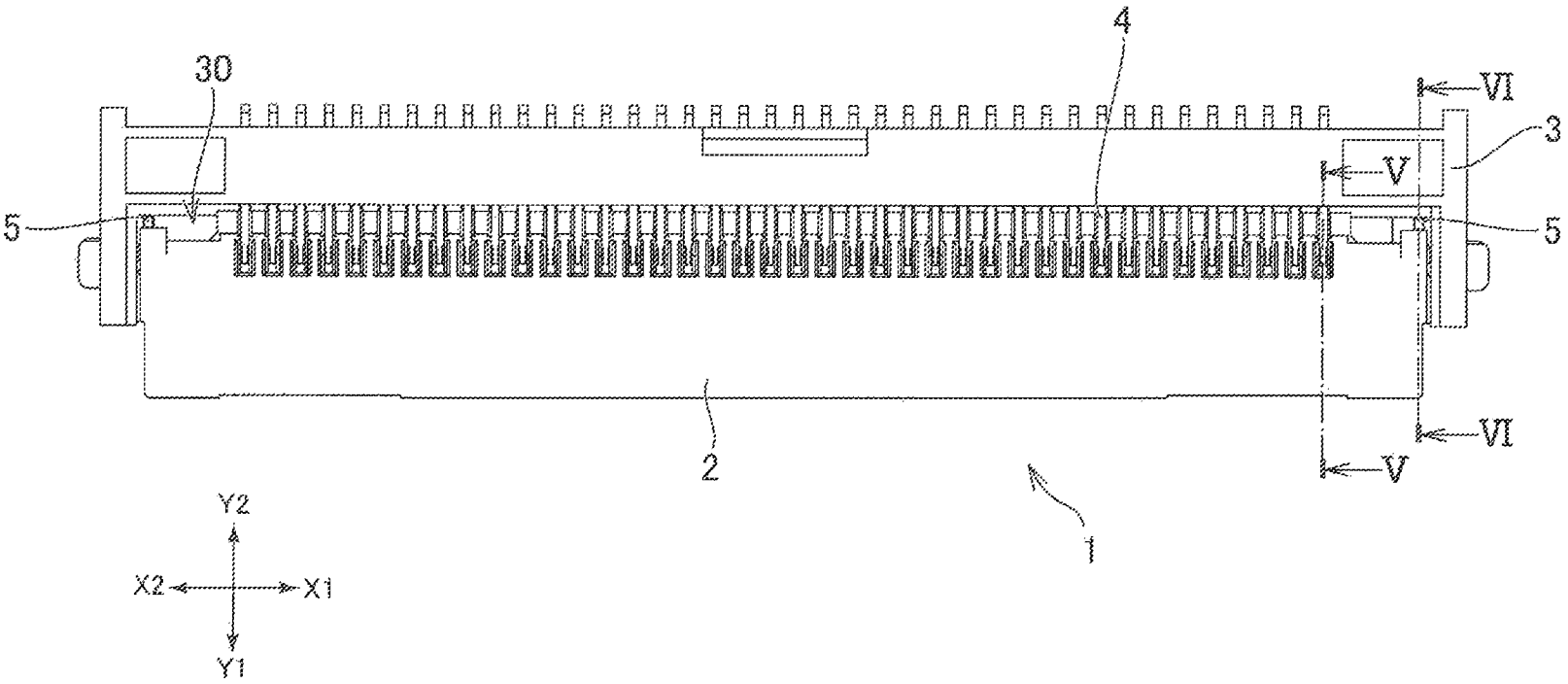
FIG. 2 is a top view of the connector.

FIG. 2 is a top view of the connector 1. As shown in the figure, a plurality of terminals 4 are inserted side by side at a predetermined pitch in the left to right direction. Two support members 5 are also inserted on the outside to the left and the right so as to interpose the terminals 4. The terminals 4 and the support members 5 may be made of metal.

Because the actuator 2 is interposed vertically between the terminals 4 and the support members 5, it is kept from becoming detached from the connector 1. Here, the actuator 2 is able to rotate around engaging portions which engage the hooks 43 of the terminals 4 as described below. The operator can pull the actuator 2 upwards and then push it downwards to the front. More specifically, the actuator 2 is either pushed down so as to be substantially parallel to the housing 3 and housed inside the accommodating portion 30 of the housing 3 ('closed orientation', see FIG. 1 and FIG. 2) or is pulled out so as to be substantially perpendicular to the housing 3 ('open orientation, not shown in the figures). The actuator 2 in the closed orientation is supported from below by the support members 5 inserted into the housing 3.

Figure 3:
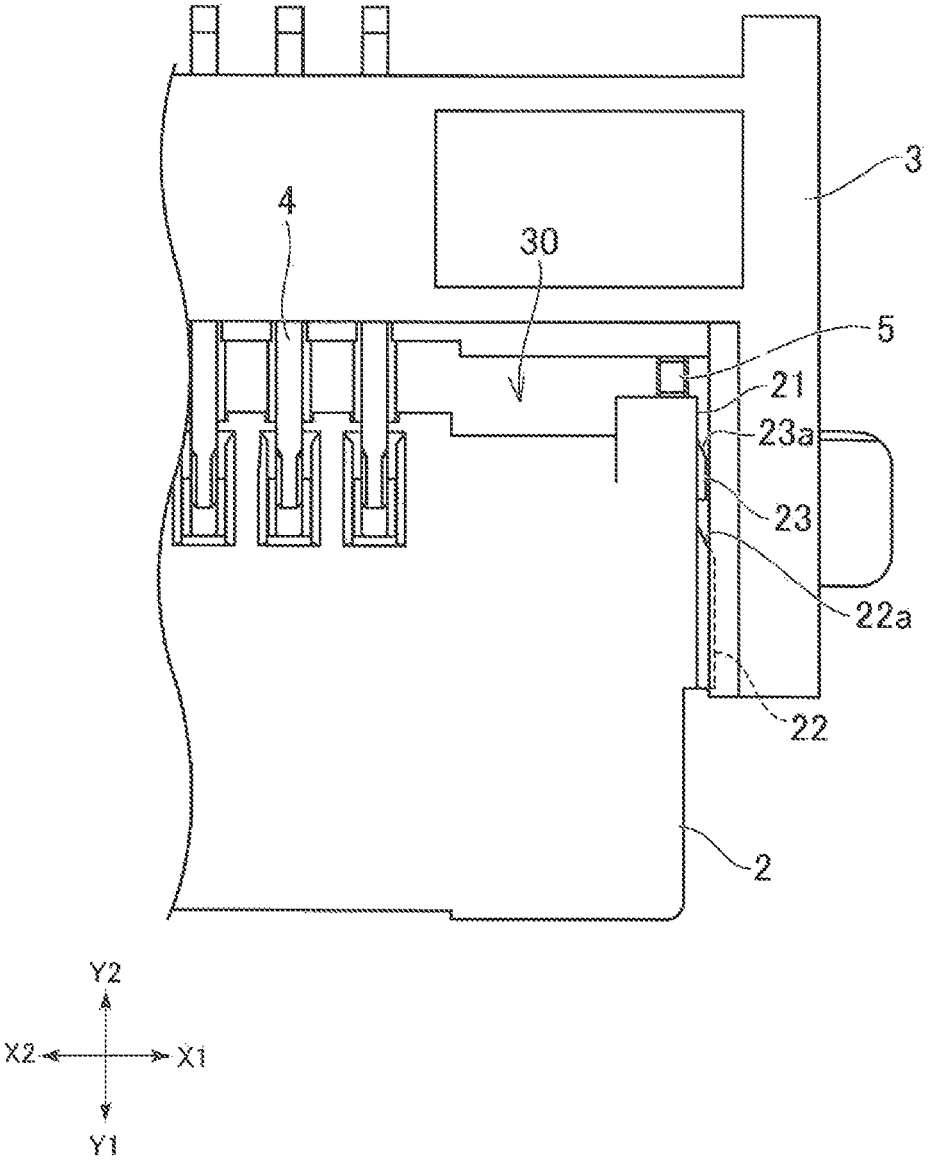
FIG. 3 is an enlarged top view of the connector.

FIG. 3 is an enlarged view of a portion of FIG. 2. As shown in the figure, the end surface 21 includes a contact pressure portion 22 which protrudes from the end surface 21, and a protruding portion 23 whose protruding length is smaller than that of the contact pressure portion 22 and which also protrudes from the end surface 21. While not shown in the figure, a contact pressure portion 22 and a protruding portion 23 are also formed on the end surface 21 found on the opposite end of the actuator 2. In other words, the actuator 2 has two contact pressure portions 22 and two protruding portions 23, one of each is formed on the two side surfaces 21 found on opposite ends of the actuator in the left and right directions.

Figure 4:
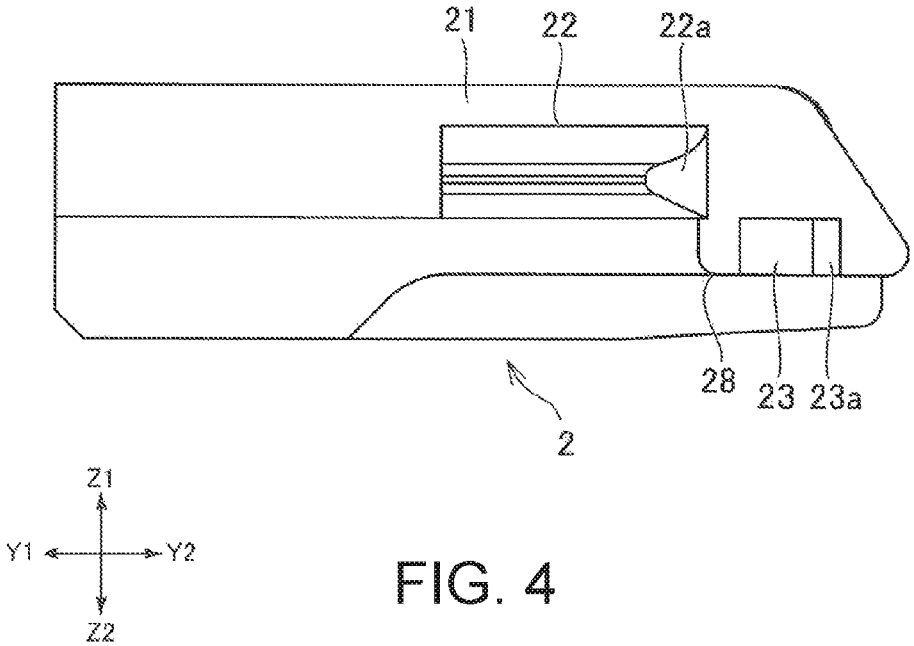
FIG. 4 is a side view of the actuator.

FIG. 4 is a side view of the actuator 2. As shown in the figure, each protruding portion 23 formed on an end surface 21 of the actuator 2 is positioned below and to the rea of the contact pressure portion 22.

As shown in FIG. 3 and FIG. 4, each contact pressure portion 22 has an inclined portion 22*a* facing the direction of the end surface 21 and extending to the rear at an incline. Each protruding portion 23 also has an inclined portion 23*a* facing the direction of the end surface 21 and extending to the rear at an incline. During the process of manufacturing the connector 1, the actuator 2 is inserted from the front end of the housing 3. At this time, the contact pressure portions 22 and the protruding portions 23 formed on the left and right of the actuator 2 have inclined portions 22*a*, 23*a* which guide the actuator 2 into the accommodating portion 30 of the housing. In other words, these inclined surfaces make it easier to insert the actuator 2.

Figure 5:
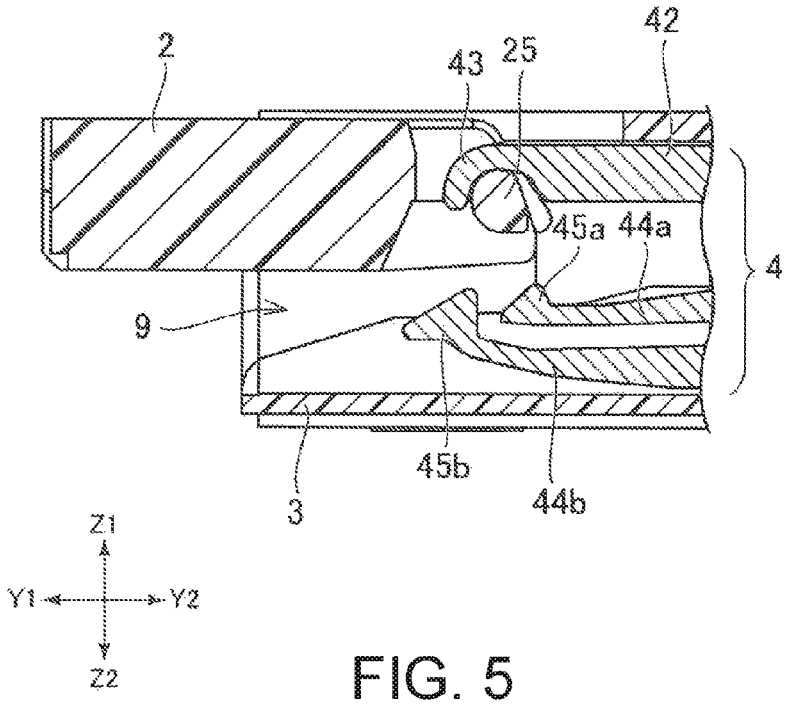
FIG. 5 is a cross-sectional view of the connector terminals.

FIG. 5 is a cross-sectional view of the connector 1, and this cross-sectional view is taken from line V-V in FIG. 2. As shown in the figure, terminals 4 are inserted into the housing 3. Each terminal 4 has a support column portion (not shown) extending vertically and arranged on the rear side of the housing 3, an upper arm portion 42 extending forward from the support column portion, and lower arm portions 44*a*, 44*b* arranged below the upper arm portion 42 and extending forward from the support column portion.

A hook 43 is formed on the leading end of the upper arm portion 42 of each terminal 4. The actuator 2 has engaging portions 25 for engaging the hooks 43, and the engaging portions 25 are arranged below the upper arm portions 42 so as to be caught by the hooks 43. In the following explanation, the state in which at least some of each engaging portion 25 has entered the depression formed below each hook 43 is referred to as the engaged state. Also, the state in which each engaging portion 25 has not entered the depression in each hook 43 is referred as the disengaged state.

When the engaging portions 25 of the actuator 2 have engaged the hooks 43 on the terminals 4, the actuator 2 can rotate around the engaging portions 25. The operator can then push down the actuator 2 into the closed orientation or pull it up into the open orientation. In the following explanation, the position of the actuator 2 when the engaging portions 25 engage the hooks 43 on the terminals 4 and the actuator itself is in the closed position is referred to as the proper position in the connector 1 for the product. The proper position in the present embodiment corresponds to the 'first position' in the present disclosure.

An opening 9 is formed in the front end of the housing 3, and the opening 9 is able to receive flat wiring (not shown) which has been inserted. When flat wiring has been inserted into the housing 3, each upper arm portion 42 is arranged above the flat wiring, and each lower arm portion 44*a*, 44*b* is arranged below the flat wiring. The lower arms 44*a*, 44*b* have contact points 45*a*, 45*b* for making contact with the flat wiring.

The flat wiring is inserted into the housing 3, the actuator 2 is pushed down from the open orientation to the closed orientation, and the flat wiring is pushed down against the front surface 26 of the actuator 2. In this way, the flat wiring is secured and kept from becoming detached from the connector 1, and the contact points 45*s*, 45*b* making contact from below establish an electrical connection with the connector 1.

Figure 6:
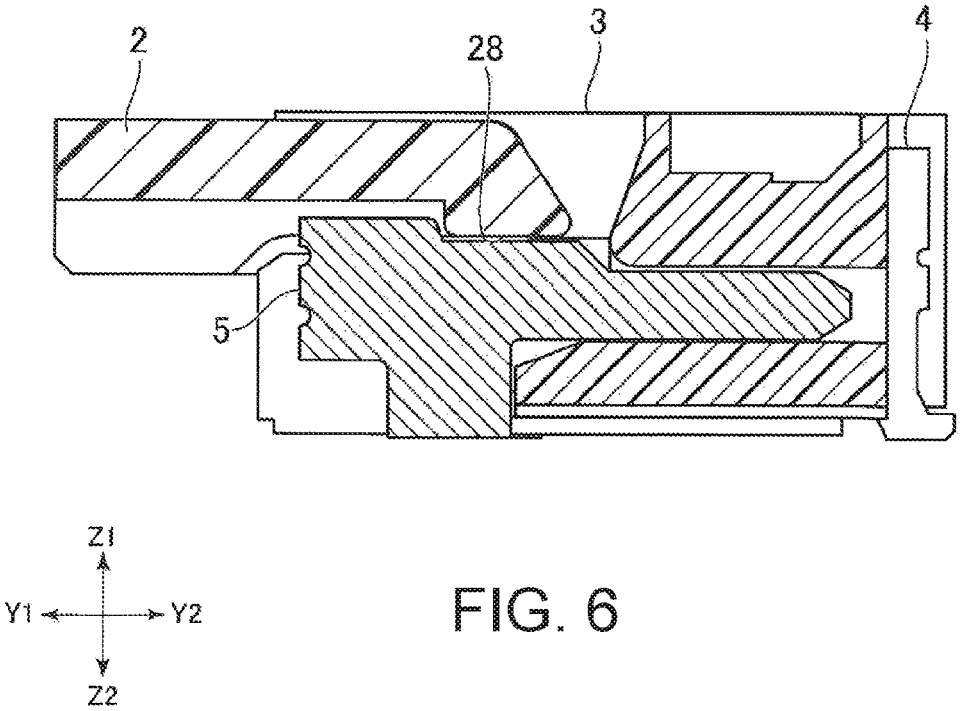
FIG. 6 is a cross-sectional view of the support member of the connector.

FIG. 6 is a cross-sectional view of the connector 1, and the cross-sectional view is from line VI-VI in FIG. 2. As shown in the figure, support members 5 are inserted into the housing 3. The support members 54 are provided below the actuator 2 near the end surfaces 21, and contact between the end surfaces 21 and the contact surfaces 28 which widen in the perpendicular direction relative to the end surfaces supports the actuator 2 from below. In this way, the actuator 2 arranged in the proper position for the product is hooked by the hooks 43 on the terminals 4 from above via the engaging portions 25, supported by the support members 5 from below, and held securely inside the housing 3.

Figure 7:
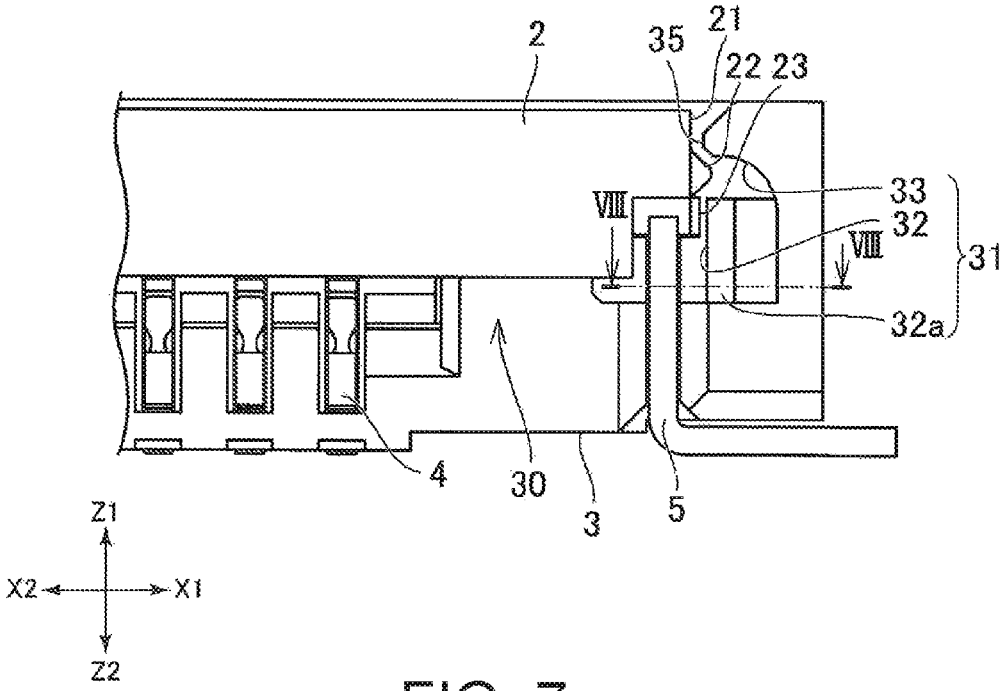
FIG. 7 is an enlarged front view of the connector.
Figure 8:
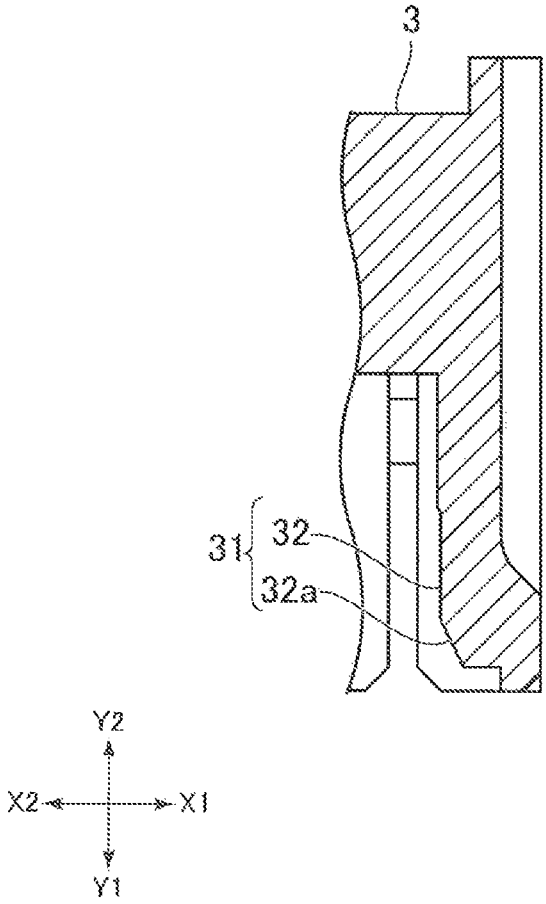
FIG. 8 is a cross-sectional view of the housing.

FIG. 7 is an enlarged view of a portion of the connector 1 from the front. Also, FIG. 8 is a cross-sectional view of the housing 3, and the cross-sectional view is from line VIII-VIII in FIG. 7. As shown in FIG. 7, each contact pressure portion 22 rises like a mountain in the direction moving away from the end surface 21. The length from the end surface 21 to the peak of the mountain (the protruding length of the contact pressure portion 22) is greater than the protruding length of the protruding portion 23.

As shown in FIG. 7 and FIG. 8, the housing 3 has two holding portions 31, one each on the left and right surfaces facing each other inside the accommodating portion 30. More specifically, each holding portion 31 has a wall surface 32 facing an end surface 21 of the actuator 2 in the closed orientation, an inclined surface 32*a* inclined forward from the wall portion 32 and away from the contact pressure portion 22 of the actuator 2, and a curved surface 33 which is depressed from the wall surface 32. Here, the curved surface 33 is formed above the wall surface 32. In the present embodiment, the wall surface 32 corresponds to the 'first surface' in the present disclosure, and the curved surface 33 corresponds to the 'second surface' of the present disclosure.

Each contact portion 22 on the actuator 2 in the closed orientation is positioned away from the curved surface 33 of the housing 3 in either the left or the right direction, and each protruding portion 23 of the actuator 2 in the closed orientation is positioned away from the wall surface 32 of the housing 3 in either the left or the right direction. In other words, the holding portions 31 of the housing 3 are formed so that the contact pressure portions 22 and the protruding portions 23 are subjected to pressure when the actuator 2 is in the proper position.

Because the contact pressure portions 22 and the protruding portions 23 formed on the left and the right of the actuator 2 in the closed orientation do not press against the holding portions 31 formed on the left and the right of the housing 3, the contact pressure portions 22 and the protruding portions 23 do not press too hard against the holding portions 31 when the actuator 2 temporarily expands inside the housing 3 due to the heat from the reflow process. In other words, the two holding portions 31 in the housing 3 are kept from moving apart from each other and the connector 1 remains flat.

Even when the actuator 2 moves to the left and right inside the accommodating portion 30 due to vibrations, the protruding portions 23 of the actuator 2 come into contact with the wall surfaces 32 provided in the holding portions 31 of the housing 3, and the actuator 2 is kept from moving very far inside the accommodating portion 30.

An accommodating protrusion 35 is formed above each holding portion 31 in the housing 3 and each one protrudes in the direction of the actuator 2 in the closed orientation. When the operator pushes the actuator 2 up into the open orientation (that is, moves the actuator 2 upwards), the contact pressure portions 22 of the actuator 2 come into contact with the accommodating protrusions 35 and then move up and over the accommodating protrusions 35. Because the contact portions 22 of the actuator 2 come into contact with the accommodating protrusions 35 when the actuator 2 moves up and down vertically inside the accommodating portion 30 due to vibrations, the actuator 2 remains inside the accommodating portion 30 (that is, remains in the closed orientation).

Also, during the manufacturing process for the connector 1, the actuator 2 is inserted into the housing 3 from the front end. Because the holding portions 31 pressing against the contact portions 22 of the actuator 2 at this time have inclined surfaces 32*a*, the actuator 2 is easily guided into the accommodating portion 30. In other words, the actuator 2 can be more easily inserted.

Figure 9:
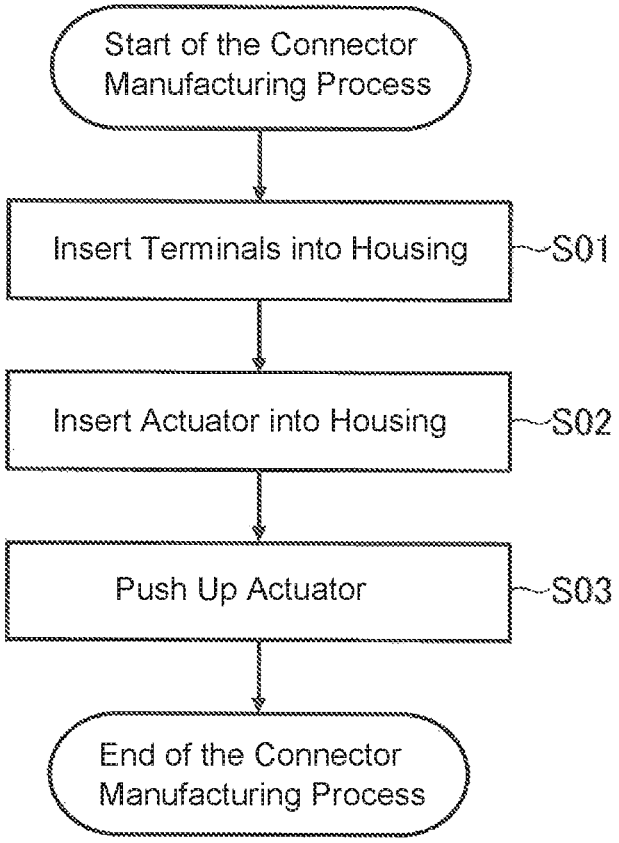
FIG. 9 is a flowchart of the connector manufacturing method.

The following is an explanation of the method for manufacturing the connector 1. FIG. 9 is a flowchart showing the manufacturing method for the connector 1. As shown in the figure, the manufacturing method for the connector 1 includes a step in which the terminals 4 are inserted into the housing 3 (Step S01), a step in which the actuator 2 is inserted into the housing 3 (Step S02), and a step in which the actuator 2 is pushed up (Step S03).

In the step of inserting the actuator 2 into the housing 3 (Step S02), the actuator 2 is inserted into a temporary holding position in the housing 3.

Figure 10:
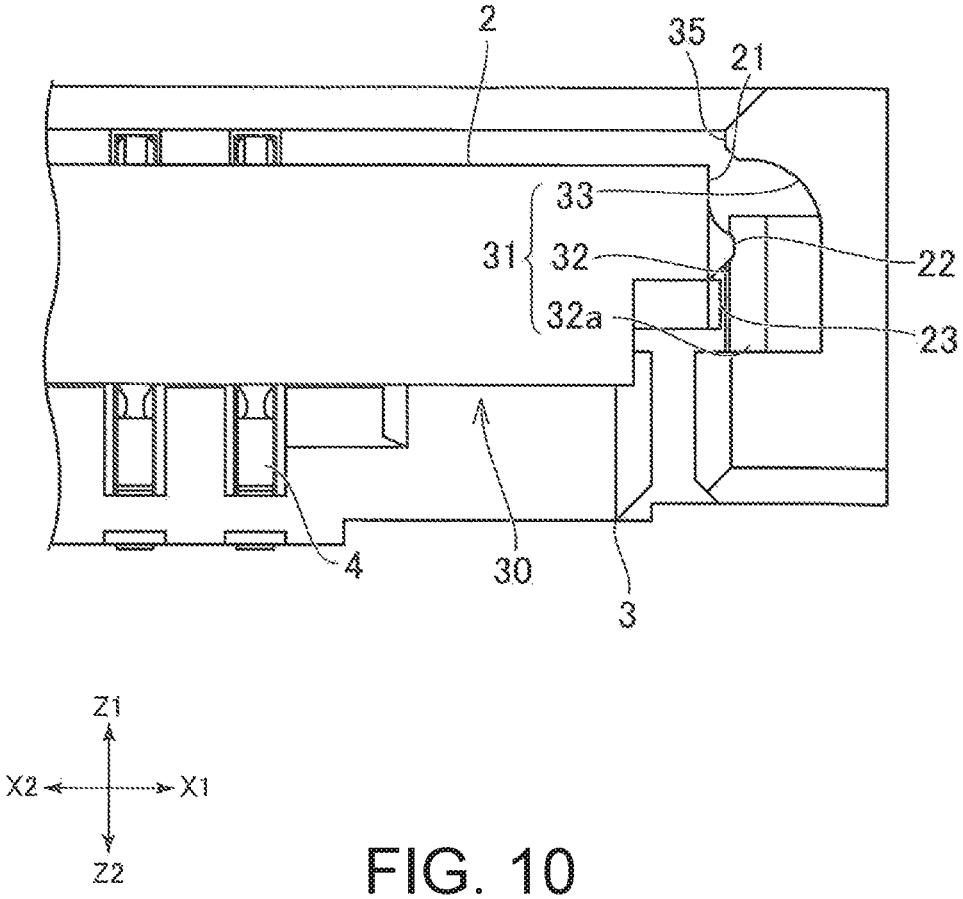
FIG. 10 is an enlarged front view of the connector in the manufacturing process.

FIG. 10 is an enlarged view of a portion of a front view of the connector 1 during the manufacturing process. As shown in the figure, the temporary holding position in the housing 3 receiving the inserted actuator 2 in Step S02 is defined as below the position of the actuator 2 in the closed orientation (that is, the proper position). In other words, the temporary holding position is the position of the actuator 2 when the engaging portions 25 of the actuator 2 (see FIG. 5) have not engaged the hooks 43 of the terminals 4 (see FIG. 5). Here, the holding portions 31 of the housing 3 (more specifically, the wall surfaces 32) are formed so that the contact pressure portions 22 of the actuator 2 push against them when the actuator is in the temporary holding position.

Afterwards, in Step S03, the actuator 2 is pushed up from the temporary holding position in the housing 3, and moves into the proper position where the engaging portions 25 engage the hooks 43 (see FIG. 7). More specifically, in Step S03, the actuator 2 inserted into the temporary holding position is pushed up from below by the insertion of the supporting members 5 into the housing 3.

Immediately after the actuator 2 has been inserted into the temporary holding position (see FIG. 10), the engaging portions 25 of the actuator 2 do not engage the hooks 43 on the terminals 4. However, because the actuator 2 is pressed against by two holding portions 31, one each formed on the left and right sides of the housing 3, via two contact pressure portions 22, one each formed on the left and right end surfaces 21 of the actuator 2, the actuator 2 is provisionally held in the temporary holding position and is kept from becoming detached from the connector 1.

When the actuator 2 has been pushed up into the proper position (see FIG. 7), the holding portions 31 of the housing 31 no longer press against the contact pressure portions 22 of the actuator 2. As a result, the contact pressure portions 22 do not press too hard against the holding portions 31 when the actuator 2 expands inside the housing 3 and the connector 1 remains flat.

The present disclosure is not restricted to the embodiments described above as many variations are possible. The disclosures in the present specification are merely examples of the present disclosure and any person skilled in the art could easily devise variations that maintain the spirit of the present disclosure and remain within the scope of the present disclosure. The width, thickness, and shape of each component in the drawings are schematic representations and do not limit the interpretation of the present disclosure in any way.

The invention claimed is:

1. A connector comprising:

a housing able to receive flat wiring inserted from the front;

terminals held inside the housing, each terminal having an arm portion positioned proximate to the flat wiring; and an actuator for pressing against the flat wiring, the actuator having engaging portions for engaging a hook formed in each arm portion, two contact pressure portions formed on two end surfaces on opposite sides from each other in a left and right direction;

the housing having two holding portions on the opposing left and right sides interposing the actuator, the holding portions pressing against the contact pressure portions of the actuator in a second position and the holding portions not pressing against the contact pressure portions of the actuator in a first position, the position of the actuator when the engaging portions are engaging the hooks being the first position and the position of the actuator when the engaging portions are not engaging the hooks being the second position.

2. The connector according to claim 1, wherein the engaging portions of the actuator are positioned below the hooks and are caught by the hooks, and the second position is defined below the first position.

3. The connector according to claim 1, wherein each holding portion has a first surface facing an end surface of the actuator and a second surface indented relative to the first surface, each contact pressure portion of the actuator presses against the first surface of the holding portion in the second position, and each contact pressure portion of the actuator does not press against the first surface and moves away from the second surface of the holding portion in the first position.

4. The connector according to claim 3, wherein each second surface is formed above the first surface.

5. The connector according to claim 3, wherein each holding portion also has an inclined surface positioned in front of the first surface and inclined away from the contact pressure portion of the actuator.

6. The connector according to claim 1, wherein each contact pressure portion of the actuator protrudes from the end surface.

7. The connector according to claim 3, wherein the actuator also has a protruding portion protruding from each end surface and having a protrusion length smaller than that of the pressure contact portion, and each protruding portion on the actuator in the first position does not press against the first surface of a holding portion but rather is apart from the first surface.

8. The connector according to claim 1, wherein the housing also has a bulging portion above each holding portion, and the contact pressure portions of the actuator press against a bulging portion when the actuator is moving upwards.

9. A method of manufacturing a connector comprising the steps of:

inserting terminals each having an arm portion positioned proximate flat wiring into a housing able to receive flat wiring inserted from the front and having two holding portions opposing each other on left and right sides;

inserting an actuator for pressing against the flat wiring and having engaging portions for engaging hooks formed in the arm portions, and two contact pressure portions formed on each of two end surfaces on opposite sides of each other in a left and right direction, the actuator being inserted into a second position in the housing; and pushing the actuator into a first position in the housing;

the second position being the position of the actuator when the engaging portions are not engaging the hooks, and the position of the actuator when the holding portions are pressing against the contact pressure portions; and the first position being the position of the actuator when the engaging portions are engaging the hooks, and the position of the actuator when the holding portions are not pressing against the contact pressure portions.

10. A connector comprising:

a housing able to receive flat wiring inserted from the front; and an actuator for pressing against the flat wiring, the actuator having engaging portions, two contact pressure portions formed on two end surfaces on opposite sides from each other in a left and right direction;

the housing having two holding portions on the opposing left and right sides interposing the actuator, the holding portions pressing against the contact pressure portions of the actuator in a second position and the holding portions not pressing against the contact pressure portions of the actuator in a first position, a position of the actuator when the engaging portions are engaged being the first position and a position of the actuator when the engaging portions are not engaged being the second positioned; and wherein each holding portion has a first surface facing an end surface of the actuator and a second surface indented relative to the first surface, each contact pressure portion of the actuator presses against the first surface of the holding portion in the second position, and each contact pressure portion of the actuator does not press against the first surface and moves away from the second surface of the holding portion in the first position.

11. The connector according to claim 10, wherein the second position is defined below the first position.

12. The connector according to claim 10, wherein each second surface is formed above the first surface.

13. The connector according to claim 10, wherein each holding portion also has an inclined surface positioned in front of the first surface and inclined away from the contact pressure portion of the actuator.

14. The connector according to claim 10, wherein each contact pressure portion of the actuator protrudes from the end surface.

15. The connector according to claim 10, wherein the actuator also has a protruding portion protruding from each end surface and having a protrusion length smaller than that of the pressure contact portion, and each protruding portion on the actuator in the first position does not press against the first surface of a holding portion but rather is apart from the first surface.

16. The connector according to claim 10, wherein the housing also has a bulging portion above each holding portion, and the contact pressure portions of the actuator press against a bulging portion when the actuator is moving upwards.

* * * * *